US009469126B2

(12) United States Patent
Willems

(10) Patent No.: US 9,469,126 B2
(45) Date of Patent: Oct. 18, 2016

(54) METHOD AND APPARATUS FOR SURFACE PRE-TREATMENT OF INK-RECEIVING SUBSTRATES, PRINTING METHOD AND PRINTER

(71) Applicant: OCE-TECHNOLOGIES B.V., Venlo (NL)

(72) Inventor: Guido G. Willems, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/851,450

(22) Filed: Sep. 11, 2015

(65) Prior Publication Data

US 2016/0001580 A1 Jan. 7, 2016

Related U.S. Application Data

(63) Continuation of application No. PCT/EP2014/057808, filed on Apr. 16, 2014.

(30) Foreign Application Priority Data

Apr. 24, 2013 (EP) ..... 13165163
May 3, 2013 (EP) ..... 13166468

(51) Int. Cl.
*B41J 11/00* (2006.01)
*B41M 5/00* (2006.01)

(52) U.S. Cl.
CPC ..... *B41J 11/0015* (2013.01); *B41J 11/002* (2013.01); *B41M 5/0011* (2013.01); *B41M 5/0047* (2013.01); *B41M 5/0064* (2013.01)

(58) Field of Classification Search
CPC . B41J 11/0015; B41J 11/002; B41M 5/0011; B41M 5/0064; B41M 5/0047
See application file for complete search history.

(56) References Cited

U.S. PATENT DOCUMENTS 3,280,740 A * 10/1966 Lewis Balamuth .... B41F 17/00 101/120
3,291,679 A * 12/1966 O'Brien ..... C08F 8/00 162/164.3
7,150,901 B2 12/2006 Campbell et al.
2005/0123696 A1 6/2005 Campbell et al.

FOREIGN PATENT DOCUMENTS

JP 6-41337 A 2/1994

* cited by examiner

*Primary Examiner* — Justin Seo
(74) *Attorney, Agent, or Firm* — Birch, Stewart, Kolasch & Birch, LLP

(57) ABSTRACT

A method of surface pre-treatment of a variety of ink-receiving substrates of different types includes applying treatment energy to the surface of the substrates in a controlled atmosphere that contains nitrogen and oxygen. The amount of energy per surface area is adjusted dependent upon the type of substrate. The ratio of oxygen to nitrogen in the controlled atmosphere is adjusted dependent upon the type of substrate.

10 Claims, 3 Drawing Sheets

METHOD AND APPARATUS FOR SURFACE PRE-TREATMENT OF INK-RECEIVING SUBSTRATES, PRINTING METHOD AND PRINTER

CROSS-REFERENCE TO RELATED APPLICATIONS

This application is a Continuation of International Application No. PCT/EP2014/057808, filed on Apr. 16, 2014, and for which priority is claimed under 35 U.S.C. §120. PCT/EP2014/057808 claims priority under 35 U.S.C. §119(a) to Application Nos. 13165163.0 and 13166468.2, filed in Europe on Apr. 24, 2013 and May 3, 2013, respectively. The entire contents of each of the above-identified applications are hereby incorporated by reference into the present application.

BACKGROUND OF THE PRESENT INVENTION

1. Field of the Invention

The present invention relates to a method of surface pre-treatment of a variety of ink-receiving substrates of different types, wherein treatment energy is applied to the surface of the substrates in a controlled atmosphere that contains nitrogen and oxygen, and the amount of energy per surface area is adjusted dependent upon the type of substrate.

2. Description of Background Art

When liquid ink is to be applied to the surface of the substrate, e.g. in an ink jet printer, it is frequently desired or necessary to pre-treat the substrate in order to increase the surface energy of the substrate to such a level that the surface can be wetted with the liquid ink. The pre-treatment may for example be a plasma treatment in which a plasma jet is directed onto the surface of the substrate so that ions contained in the plasma will react with the substrate surface. In another embodiment, the pre-treatment may include a corona discharge. In any case, the pre-treatment includes a transfer of energy to the surface of the substrate in order to induce a reaction that modifies the chemical and/or physical properties of the substrate surface.

U.S. Pat. No. 7,150,901 discloses a method of the type indicated above, wherein a plasma treatment is performed in the presence of ambient air or in a pure nitrogen atmosphere.

JP 6 041 337 A discloses a method for controlling the surface energy of a plastic substrate by means of a plasma or corona treatment with a mixed gas containing a fluorine-containing compound, while adjusting the mixing ratio of the components of the mixed gas.

When an ink droplet is applied to the surface of the substrate, the size of the resulting ink dot will depend upon the speed with which the liquid ink spreads over the surface of the substrate, in relation to the speed with which the ink dries-out by evaporation of the solvent, and in relation to the speed with which the liquid is absorbed into the substrate.

The surface treatment may have an influence on the absorption speed, especially in case of porous substrates, but will mainly have an effect on the speed with which the liquid spreads, because the contact angle which the liquid/air meniscus of the droplet forms with the surface of the substrate will be dependent upon an equilibrium between the surface tensions of the liquid-to-air surface, the liquid-to-substrate surface and the substrate-to-air surface. In general, the spreading speed of the liquid and, consequently, the dot size will increase when the intensity of the pre-treatment is increased. Thus, the pre-treatment provides a possibility to control the dot size of the ink dots on the substrate.

SUMMARY OF THE INVENTION

It is an object of the present invention to provide a method that improves the control of the dot size on a variety of substrates.

In order to achieve this object, the method according to the present invention includes a step of adjusting the ratio of oxygen to nitrogen in the controlled atmosphere dependent upon the type of substrate.

Thus, according to the present invention, the oxygen content of the controlled atmosphere is used as another parameter, in addition to the treatment energy, for controlling the pre-treatment conditions. This permits adjustment of the pre-treatment more adequately to the respective types of substrate.

When the controlled atmosphere consists essentially of nitrogen, i.e. when the atmosphere is practically free of oxygen, and when the intensity of the pre-treatment is gradually increased, while all other conditions are left unchanged, the resulting dot size will increase and will then reach a certain level. When the intensity is increased further, the dot size will not increase further but will essentially stay on the level that has been reached. In other words, the dot size curve as a function of the treatment intensity shows a plateau for large intensities.

However, when the pre-treatment is performed at ambient air, it has been found that, at least for some substrates, the dot size curve reaches a maximum and then starts to decrease again without ever reaching the plateau for pure nitrogen when the intensity is increased further. It is presumed that the reason for this effect is that the oxygen contained in the air reacts with the substrate to form acidic groups on the substrate surface. This has the consequence that latex or pigment inks, that are generally alkaline, tend to react with the acidic groups, and these chemical reactions compromise the spreading of the liquid, so that, when the substrate surface becomes more and more acidic with increased treatment energy, the spreading speed is reduced to such an extent that the dot size decreases.

It is generally desired that the pre-treatment energy is kept in a range in which the dot size curve is essentially flat, i.e. at a value close to the maximum of the dot size curve in case of an ambient air and to a value within the plateau in case of pure nitrogen. This has the advantage that the dot size will be independent of any possible fluctuations of the treatment intensity, which may be caused for example by a surface roughness or other surface irregularities of the substrate.

The present invention now offers the possibility to use the oxygen content as a parameter for changing the height of the peak of the dot size curve. In this way, it becomes possible to keep the treatment intensity in a range where the dot size curve is flat, and nevertheless obtain essentially the same dot size for all substrates, irrespective of the different types of substrates. The great advantage is that the pigment concentration of the ink can be optimized for that dot size. This permits optimization of the color gamut and a more consistent color management irrespective of differences between the various types of substrates.

More specific optional features of the present invention are indicated in the dependent claims.

The composition of the treatment atmosphere may be controlled in any suitable way, e.g. by supplying pure nitrogen gas and pure oxygen gas to the treatment zone with suitably adjusted flow rates. In a preferred embodiment, however, the gas composition is controlled by forcing ambient air to pass through a gas separation membrane that in general has a higher permeability for nitrogen than for oxygen. Without wanting to be bound to any theory, it is believed to be caused by the fact that nitrogen has a smaller molecular size than oxygen. Then, the nitrogen content of the gas that has passed through the membrane (i.e. at the permeation side of the membrane) will depend upon the thickness of the membrane, the flow-rate of the ambient air and/or the pressure with which the gas has been forced through the membrane. Due to selective permeation of nitrogen, the gas on the permeation side of the membrane will be nitrogen enriched. The gas that has not passed through the membrane, i.e. at the retention side of the membrane, consequently is oxygen enriched. In view of this, the method can be carried out while using just ambient air and without any need for a supply of pure gases.

In an embodiment, a tubular gas separation membrane is used as the membrane. If a tubular gas separation membrane is used, depending on the pressure and flow-rate of the ambient (pressurized) air through the tubular membrane, the permeation side of the membrane provides nitrogen enriched air and the retention side of the membrane provides oxygen enriched air.

Preferably, the pre-treatment may be carried out under a gas douche.

An apparatus for carrying out the present invention has a user interface adapted to input information on the type of substrate being used and a controller adapted to automatically adjust the oxygen content of the controlled atmosphere to the type of substrate. The controller may include or may have access to an electronic table that links the various types of substrates to the corresponding values of the oxygen content and the treatment energy.

The pre-treatment apparatus may be a stand-alone device or may be integrated in a printer.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The present invention will now be described with reference to the accompanying drawings.

Figure 1A:
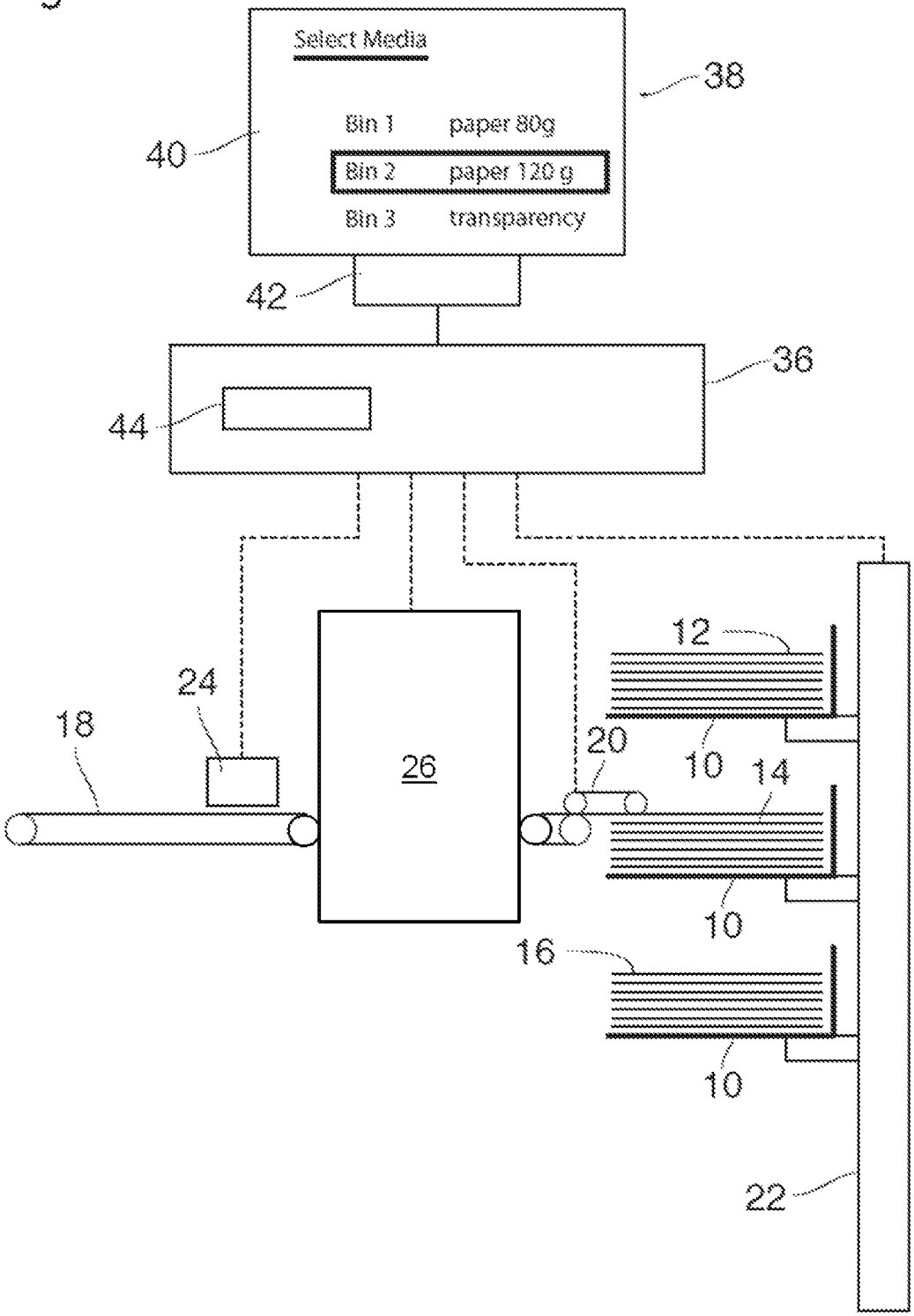
FIG. 1A is a schematic view of an ink jet printer with an integrated pre-treatment apparatus according to the present invention.

The ink jet printer shown in FIG. 1A has three bins 10 for accommodating stacks of sheets of print substrates 12, 14 and 16. Each bin 10 may be assumed to contain substrates of a different type, e.g. different qualities of paper, plastic film transparencies and the like.

A substrate transport path 18 is constituted by a motor-driven endless conveyor belt. A feed mechanism 20 is provided for withdrawing the substrate sheets one by one from the top of the stack in one of the bins 10 and feeding the sheets into the substrate transport path 18.

The bins 10 are mounted on a lift mechanism 22 arranged to lift a selected one of the bins 10 into a position in which it is level with the transport path 18, so that the substrate sheets may be drawn-in from that bin. The feed mechanism 20 can be tilted away into a position in which it does not interfere with the vertical movements of the bins 10.

An ink jet printhead 24 is arranged above the substrate transport path 18 for printing an image onto each of the substrates passing through. A pre-treatment station 26 is arranged at the transport path 18 in a position upstream of the printhead 24.

Figure 1B:
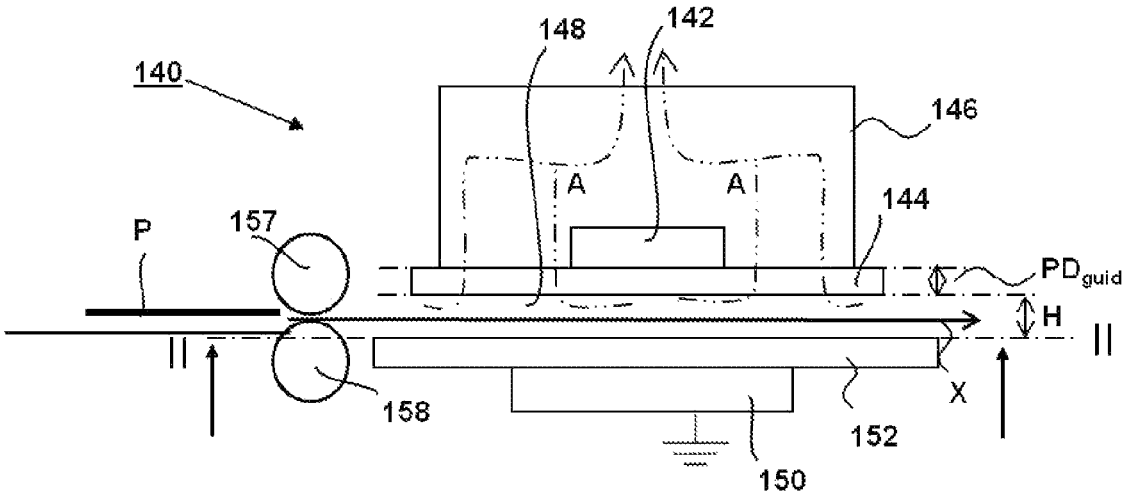
FIG. 1B is a schematic view of a pre-treatment apparatus as used in an embodiment of the present invention.

The pre-treatment station 26 includes a pre-treatment device which, in this example, comprises a plasma treatment unit 140 (see FIG. 1B).

FIG. 1B is a side view of the plasma treatment unit 140 present in the pre-treatment station 26 (see FIG. 1A) that can be used in a method according to an embodiment of the present invention. Please note that the media transport direction through the pre-treatment device is represented opposite to the media transport direction as shown in FIG. 1A. In practice, the transport directions are the same. A sheet of recording substrate P is transported by a sheet transporting mechanism through a transport path 148 in the direction indicated by arrow X along the plasma treatment unit 140. The transport path 148 has a height H, which is sufficient to accommodate the thickness of the transported cut sheet material. It should be noted that the transport path height H in FIG. 1B is shown schematically and is typically in the range of from 1 to 3 mm. The sheet transport mechanism comprises a driving roller 158 and a free rotatable roller 157, which together form a transport pinch. The plasma treatment unit 140 comprises a body 146, a plasma generating mechanism comprising a high voltage electrode 142, and a sheet guide 144. The sheet guide 144 is positioned between the high voltage electrode 142 and the transport path 148. The sheet guied 144 provides a predetermined distance $PD_{guid}$ between the transport path 148 and the high voltage electrode 142. The predetermined distance $PD_{guid}$ in FIG. 1B is shown schematically and is typically in the range of between 1 and 3 mm, preferably about 1.5 mm. The sheet guide 144 may be constituted of a ceramic material, such as aluminium oxide ($Al_2O_3$), silicon nitride ($Si_3N_4$) or silicon carbide (SiC). The plasma generating mechanism further comprises a counter electrode 150. The counter electrode 150 is electrically grounded. Further, the sheet transport mechanism comprises a sheet supporting surface 152 for supporting the sheet P during transport in the direction of the sheet transport path 148 along the high voltage electrode 142.

An air flow indicated by arrows A is provided inside of the plasma treatment unit 140. The air flow removes air contaminations, which are generated between the high voltage electrode 142 and the counter electrode 150, and directs the contaminations towards an air pump device (not shown). The air pump device further contains a filter in order to remove the air contaminations, such as ozone, from the air flow (gas douche).

In this embodiment, a sheet of a recording substrate may be transported between the high voltage electrode and the counter electrode. In this configuration, the gas present in the pores (e.g. air-pockets) of the substrate is also ionized and hence the whole thickness of the substrate is plasma treated, unlike the treatment with a plasma gun wherein the counter electrode is comprised in the gun.

In another embodiment, the sheet supporting surface 152 comprises an electrical insulating layer, for example a ceramic layer, such as a glass layer, or a polymeric layer. The electrical insulating layer arranged in between the counter electrode 150 and the transport path 148 provides that the surface treatment of the sheet of recording substrate P during the plasma treatment process of the high voltage electrode 142 towards the surface of the cut sheet material attains a certain treatment widening. This improves the uniformity and quality of the surface treatment of the sheet of recording substrate P.

The gas douche is provided for creating, in the operating range of the pr-treatment device (the plasma treatment unit 140), an atmosphere that is mainly formed by a mixture of nitrogen and oxygen with a controlled oxygen content.

Figure 1C:
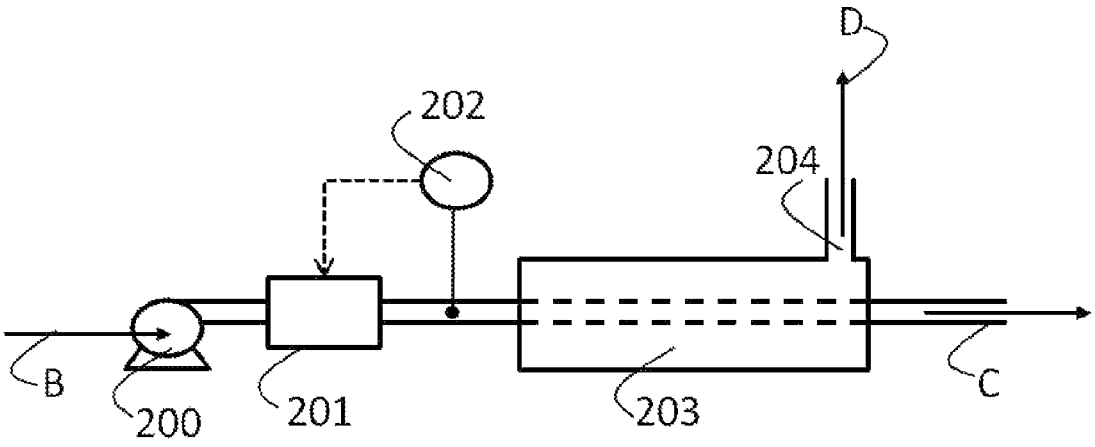
FIG. 1C is a schematic view of a gas membrane module as used in an embodiment of the present invention.

The oxygen content in the air may be controlled with a gas separation membrane as shown in FIG. 1C.

In the example shown, the oxygen content is controlled by means of a blower 200, which sucks-in ambient air (arrow B) and forces the air through a tubular gas separation membrane 203 of which the exit permeation side 204 is connected to the body 146 (see FIG. 1B) of the plasma treatment unit 140, such that the composition of the gas that is ionized in the plasma region can be controlled.

The pressure and/or the mass flow rate in the feed line of the tubular gas separation membrane 203 is measured with a sensor 202 and with this signal the feed flow-rate of the gas separation membrane 203 is controlled.

The air-flow that is pressed through the gas separation membrane 203 (indicated with arrow D), is nitrogen enriched. The air flow that passes through the retention side of the membrane (indicated with arrow C) comprises oxygen enriched air. The design characteristics, including the thickness of the gas separation membrane 203, are selected such that a desired range of nitrogen contents can be covered by varying the pressure and flow-rate at the entrance of the gas separation membrane.

In an embodiment, the gas separation membrane can be operated in a steady state, i.e. the out-coming gas flows (indicated with arrows C and D in FIG. 1C) have a constant nitrogen content (C: Oxygen enriched; D: Nitrogen enriched). The desired concentration of nitrogen and oxygen can be obtained by mixing the permeated gas flow (D) with the outcoming gas flow (C) and/or with ambient air.

An electronic controller 36 (see FIG. 1A) is provided for controlling the various components of the ink jet printer, including the printhead 24, the sheet conveying mechanism (motor-driven endless conveyor belt), the lift mechanism 22 and also the pre-treatment station 26 having the blower 200, a mass flow controller 201 and pre-treatment device (the plasma treatment unit 140).

A user interface 38 (see FIG. 1A) is connected to the controller 36 and includes a display screen 40 and an input section 42 permitting a user to specify (among other things) the types of the substrates 12, 14 and 16 that are presently contained in the bins 10. The bins and the loaded types of substrate are shown on the display screen 40, permitting the user to select one of the bins and the corresponding type of substrate for printing.

The controller 36 includes an electronic table 44 that stores, for each of the substrates 12, 14 and 16, an associated value for the treatment energy to be delivered by the pre-treatment device (plasma treatment unit 140) and an associated value for the oxygen content of the atmosphere to be created in the gas douche. In this example, the oxygen content may be indicated implicitly by corresponding values for the displacement or output pressure of the blower 200. The table 44 may also include additional data sets for other types of substrate that might be loaded into the bins 10 in place of the substrates 12, 14, 16.

When the user has selected a specific bin and, therewith, a specific type of substrate, the controller 36 will automatically control the pre-treatment device (plasma treatment unit 140) and the blower 200 so as to provide the required pre-treatment conditions.

Figure 2:
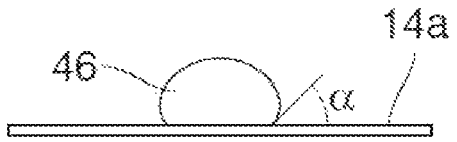
FIGS. 2 and 3 illustrate the shapes of ink droplets on a treated and a non-treated substrate surface, respectively.
Figure 3:
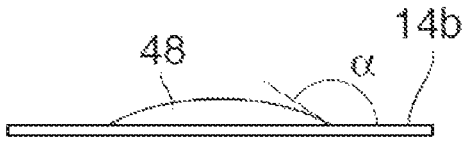

The effect of the pre-treatment of the substrates is illustrated in FIGS. 2 and 3.

In FIG. 2, an ink droplet 46 has been jetted onto the surface of a substrate sheet 14*a* that has not been pre-treated. In this case, the surface energy of the substrate is small in comparison to the surface tension of the liquid ink in the droplet 46. This means that the substrate surface is hydrophobic (in case of water-based inks) and the adhesion force between the substrate and the liquid ink is smaller than the cohesion force of the liquid, with the result that the ink does not wet the substrate, and the contact angle a between the ink droplet and the substrate surface is smaller than 90°.

For comparison, FIG. 3 shows an ink droplet 48 on a substrate sheet 14*b* that has been pre-treated and therefore has a higher surface energy. In this case, the difference in surface tension between the substrate-to-air surface of the substrate sheet and the substrate-to-liquid surface of the substrate sheet is larger than the surface tension of the ink droplet 48 (liquid-to-air), so that the substrate surface is wetted with ink and the ink droplet 48 is spread until an equilibrium condition is reached at a contact angle a that is significantly larger than 90°.

In the course of time, the solvent in the liquid will evaporate, and part of the ink may also be absorbed into the depth of the substrate sheet, so that what is finally left on the surface of the substrate is an ink dot of a predetermined size. This dot size will depend critically upon the speed with which the ink droplet 48 spreads due to the mechanism described above. Consequently, the surface tension of the substrate sheet 14*b*, as it results from the pre-treatment, has an important influence on the dot size.

On the other hand, the spreading of the ink droplet 48 and the resulting dot size is also influenced by the chemistry at the surface of the substrate sheet. When the substrate surface is acidic, while the ink is alkaline (as is the case for most latex and pigment inks), chemical reactions between the substrate and the ink will tend to slow down the spreading of the ink droplet 48 and reduce the resulting dot size. The chemistry of the treated substrate surface will depend on the intensity (energy per unit area) of the treatment, but also the composition, especially the oxygen content, of the atmosphere in the treatment zone.

Figure 4:
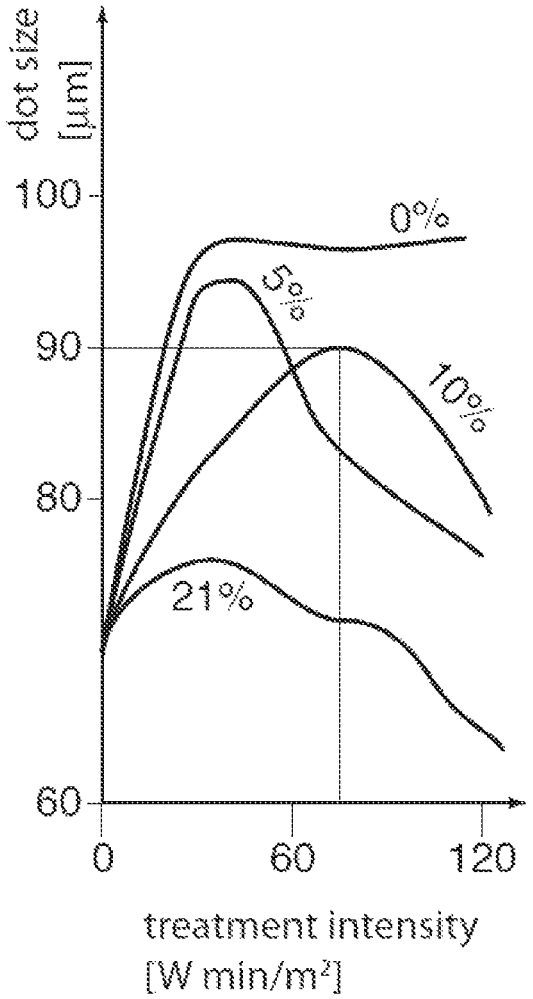
FIGS. 4 and 5 are diagrams showing dot size curves for different pre-treatment atmosphere compositions.

FIG. 4 illustrates examples of dot size curves indicating the dot size as a function of the treatment intensity for a specific type of substrate (e.g. the substrate 14 in FIG. 1A) and for oxygen contents of 0% (pure nitrogen), 5%, 10% and 21% (ambient air), respectively.

It can be seen that, in the presence of oxygen, the dot size has a peak at a certain treatment intensity and then tends to decrease again when the intensity is increased further. The height of the peak is generally lower when the oxygen content is higher.

Figure 5:
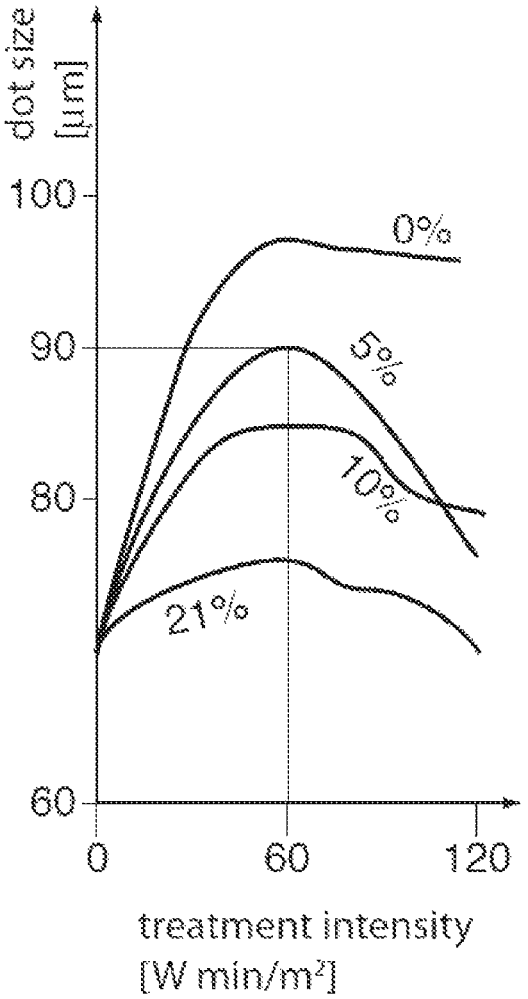

FIG. 5 shows corresponding dot size curves for a different type of substrate (e.g. the substrate 16 in FIG. 1A). Although the general shape of the dot size curves is similar, the heights of the peaks and the intensity values where the maximum is reached are different, due to different surface properties of the substrate.

The controller 36 will control the pre-treatment conditions such that a uniform dot size (of e.g. 90 μm in this example) will be achieved for all types of substrates (if the volume of the ink droplets and all other conditions are the same). In principle, as can be seen in FIGS. 4 and 5, this could be achieved with a pure nitrogen atmosphere (dot size curves for 0%), simply by appropriately adjusting the treatment intensity (to about 20 W min/$m^2$ in FIG. 4 and approximately 30 W min/$m^2$ in FIG. 5). However, in this intensity range, the dot size curves for 0% are very steep, which means that the dot size would depend critically upon the exact value of the treatment intensity, and even minor fluctuations in the intensity would lead to visible fluctuations of the dot size and, consequently, to a poor image quality.

This is why, according to the present invention, the dot size is controlled by adjusting both the treatment intensity and the oxygen content of the atmosphere. In FIG. 4, an atmosphere with an oxygen content of 10% is used, and the intensity is adjusted such that the dot size reaches its maximum of 90 μm. In this range, the dot size curve for 10% is flat, so that the dot size is largely insensitive to fluctuations of the treatment intensity.

In FIG. 5, the same dot size of 90 μm is achieved by using an atmosphere with an oxygen content of only 5% and adjusting the intensity to the maximum of the dot size curve for 5%. Again, this curve is flat in the vicinity of the selected intensity value, so that the dot size will also be insensitive to intensity fluctuations.

It will be understood that, by varying the oxygen content of the atmosphere and appropriately adjusting the treatment intensity, the resulting dot size may be varied in a relatively wide range, and still the dot size will be the same for all types of substrates being used. In general, in order for the dot size to be insensitive to intensity fluctuations, it is sufficient that the dot size curve is flat in the vicinity of the selected intensity value, i.e., the curve must have a point of zero derivative which may also be a local minimum or a saddle point rather than a local maximum or peak.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A method of surface pre-treatment of a plurality of ink-receiving substrates of different types, said method comprising the steps of:

applying treatment energy to the surface of the substrates in a controlled atmosphere that contains nitrogen and oxygen;

adjusting the amount of energy per surface area dependent upon the type of substrate; and adjusting the ratio of oxygen to nitrogen in the controlled atmosphere dependent upon the type of substrate.

2. The method according to claim 1, further comprising the steps of:

selecting, for each of the plurality of different types of substrates, the ratio of oxygen to nitrogen such that a dot size curve indicating a size of an ink dot resulting from an ink droplet with a given volume as a function of the treatment energy has a point of zero derivative at the same level for each of the plurality of different types of substrates;

adjusting the treatment energy for each of the plurality of different types of substrates to said point of zero derivative of the dot size curve of that substrate.

3. The method according to claim 1, wherein the controlled atmosphere is supplied via a gas douche.

4. The method according to claim 1, wherein the step of adjusting the ratio of oxygen to nitrogen in the controlled atmosphere further comprises the steps of:

passing ambient air through a membrane that has different permeabilities for oxygen and nitrogen; and adjusting the differential pressure across the membrane.

5. The method according to claim 1, further comprising the steps of:

storing a value for the ratio of oxygen to nitrogen and a value for the treatment energy for each of the plurality of different types of substrates in an electronic table;

specifying a type of substrate in a controller that has access to the electronic table; and adjusting the ratio of oxygen to nitrogen and the treatment energy by means of the controller.

6. An apparatus for surface pre-treatment of a plurality of ink-receiving substrates of different types, comprising:

a pre-treatment device for applying treatment energy;

a gas supply system adapted to create an atmosphere with a controllable oxygen to nitrogen ratio in a treatment zone of the pre-treatment device; and a controller adapted to control both the oxygen to nitrogen ratio and the treatment energy applied by the pre-treatment device, dependent upon the type of substrate.

7. The apparatus according to claim 6, wherein the gas supply system comprises a gas douche.

8. The apparatus according to claim 6 wherein the gas supply system further comprises:

a membrane with different permeabilities for oxygen and nitrogen; and a blower arranged to press ambient air through the membrane.

9. A method of printing, comprising the steps of:

applying liquid ink to a plurality of different types of substrates; and using the method according to claim 1 to pre-treat the substrates.

10. A printer comprising the apparatus according to claim 6.

* * * * *